United States Patent [19]

Chen et al.

[11] 4,443,325

[45] Apr. 17, 1984

[54] CONVERSION OF RESIDUA TO PREMIUM PRODUCTS VIA THERMAL TREATMENT AND COKING

[75] Inventors: Nai Y. Chen, Titusville; Lillian A. Rankel, Princeton, both of N.J.

[73] Assignee: Mobil Oil Corporation, New York, N.Y.

[21] Appl. No.: 452,482

[22] Filed: Dec. 23, 1982

[51] Int. Cl.[3] ..... C10B 55/10; C10G 65/18

[52] U.S. Cl. ..... 208/55; 208/50; 208/52 R; 208/85; 208/131

[58] Field of Search ..... 208/52 R, 55, 50, 85, 208/131

[56] References Cited

U.S. PATENT DOCUMENTS

| | | | |
|---|---|---|---|
| 2,079,168 | 5/1937 | Heid | 208/50 |
| 2,636,844 | 4/1953 | Kimberlin, Jr. et al. | 208/55 |
| 2,906,690 | 9/1959 | Brown | 208/52 |
| 4,049,538 | 9/1977 | Hayashi et al. | 208/50 |
| 4,235,700 | 11/1980 | Metrailer | 208/131 |
| 4,247,387 | 1/1981 | Akbar | 208/131 |

*Primary Examiner*—Delbert E. Gantz
*Assistant Examiner*—Lance Johnson
*Attorney, Agent, or Firm*—Alexander J. McKillop; Michael G. Gilman; Charles J. Speciale

[57] ABSTRACT

A combined process for treating heavy hydrocarbon feedstocks, such as resids that minimizes coke production and maximizes naphtha production, comprising the steps of thermally treating the feedstocks, in the absence of an added catalyst and either with or without hydrogen and steam, at a temperature of at least about 750° F. (399° C.) and under a pressure greater than about 400 psig to create significant chemical transformations without causing phase separation and consequent formation of sludge or a coke deposit; topping the thermally treated product to produce a distillate fraction and a bottoms fraction; coking the bottom fraction to produce gas, liquid products, and coke; and finally catalytically cracking the combined distillate fraction and liquid products to recover gas, gasoline, and light distillate products.

10 Claims, 3 Drawing Figures

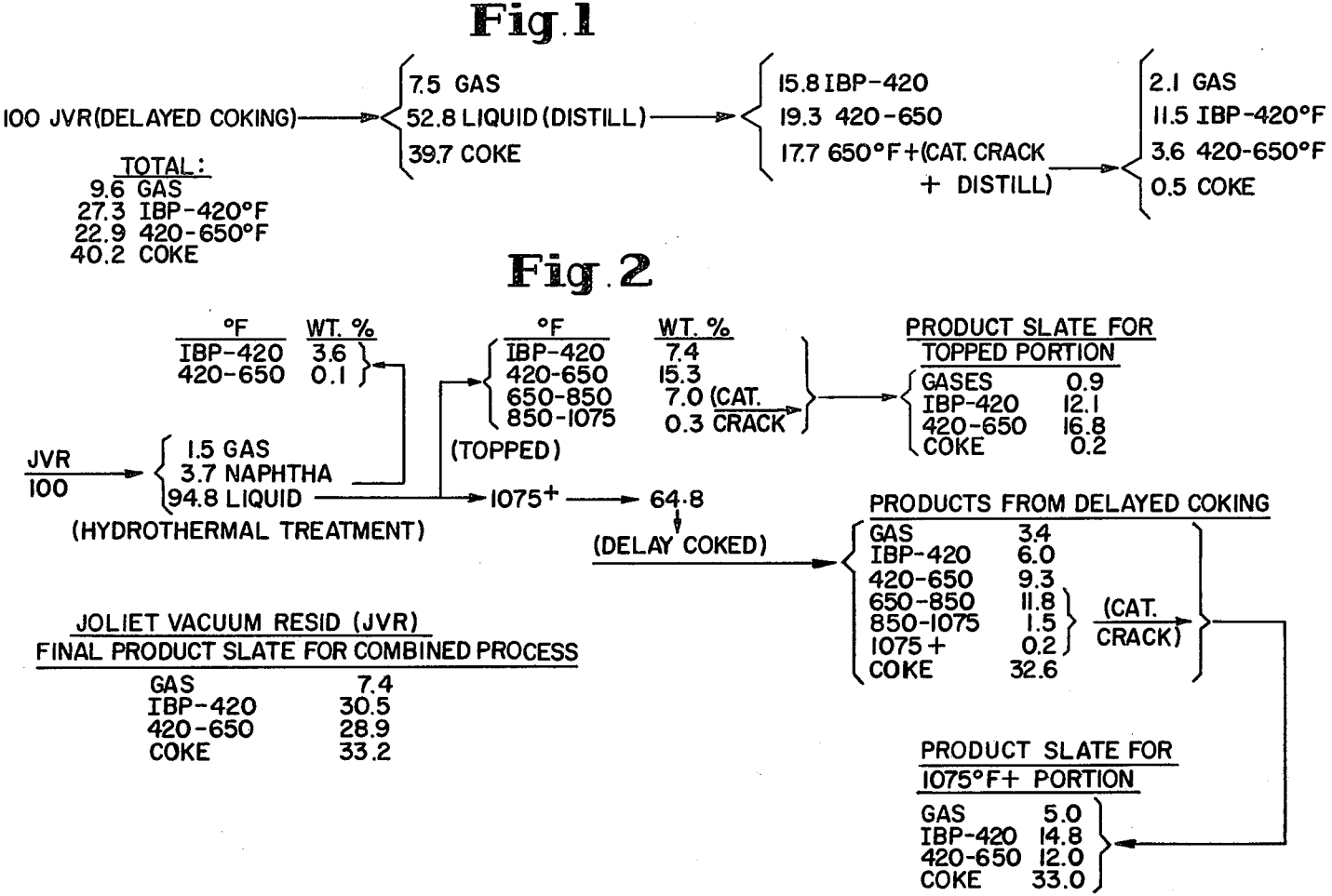
Fig. 1
100 JVR(DELAYED COKING)
7.5 GAS
52.8 LIQUID (DISTILL)
39.7 COKE
15.8 IBP-420
19.3 420-650
17.7 650°F+(CAT. CRACK + DISTILL)
2.1 GAS
11.5 IBP-420°F
3.6 420-650°F
0.5 COKE
TOTAL:
9.6 GAS
27.3 IBP-420°F
22.9 420-650°F
40.2 COKE
Fig. 2
JVR
100
1.5 GAS
3.7 NAPHTHA
94.8 LIQUID
(HYDROTHERMAL TREATMENT)
°F
IBP-420
420-650
WT. %
3.6
0.1
°F
IBP-420
420-650
650-850
850-1075
(TOPPED)
WT. %
7.4
15.3
7.0 (CAT. CRACK)
0.3
1075+
64.8
(DELAY COKED)
PRODUCT SLATE FOR TOPPED PORTION
GASES 0.9
IBP-420 12.1
420-650 16.8
COKE 0.2
PRODUCTS FROM DELAYED COKING
GAS 3.4
IBP-420 6.0
420-650 9.3
650-850 11.8
850-1075 1.5
1075+ 0.2
COKE 32.6
(CAT. CRACK)
PRODUCT SLATE FOR 1075°F+ PORTION
GAS 5.0
IBP-420 14.8
420-650 12.0
COKE 33.0
JOLIET VACUUM RESID (JVR)
FINAL PRODUCT SLATE FOR COMBINED PROCESS
GAS 7.4
IBP-420 30.5
420-650 28.9
COKE 33.2

CONVERSION OF RESIDUA TO PREMIUM PRODUCTS VIA THERMAL TREATMENT AND COKING

BACKGROUND OF THE INVENTION

1. Field of the Invention

This invention relates to upgrading residual petroleum fractions by hydrothermal treatment and coking. More specifically, the invention relates to carefully limited hydrovisbreaking of such residua, fractionating to isolate catalytic cracking feedstock and bottoms, and delay coking of the bottoms to produce coke and additional cracking feedstocks.

2. Description of the Prior Art

In conventional processing of crude petroleum oil to recover fractions suitable as chargestock for catalytic cracking, the crude is first distilled at substantially atmospheric pressure. Gas and gasoline are recovered as overhead products, naphtha and perhaps a light gas oil are taken off as side streams, and the residual material is recovered from the bottom of the tower as atmospheric reduced crude. The residual fraction from the atmospheric tower is then passed to a vacuum distillation tower. The products of vacuum distillation include gas oil and a heavy residual fraction, described as vacuum reduced crude. The gas oil fraction is employed as catalytic cracking chargestock which can be a mixture of fractions otained by atmospheric and vacuum distillation. In general, it is a liquid distillate that boils in the range of about 500°-1000° F. (260°-538° C.).

To obtain additional catalytic cracking chargestock, it is also conventional to subject petroleum fractions heavier than gas oil, including residual fractions from atmospheric and vacuum distillation, to a thermal cracking procedure known as viscosity breaking, or, more commonly, as "visbreaking". This is essentially a single-pass, mild thermal cracking operation in which the heavy oil is passed at rather short residence time through a coil heated to a temperature in the range of about 850°-950° F. (454°-510° C.). The product is then separated to recover a gas oil cracking stock and a residue which is suitable for coking.

Coking is one of the refiner's major processes for converting residuals to lighter, more valuable stocks. Petroleum coke is the residue resulting from the thermal decomposition or pyrolysis of high-boiling hydrocarbons, particularly residues obtained from cracking or distillation of asphaltenic crude distillates. The hydrocarbons generally employed as feedstocks in the coking operation usually have an initial boiling point of about 700° F. (380° C.) or higher, an API gravity of about 0°-20°, and a Conradson carbon residue content of about 5-40 weight percent.

The coking process is particularly advantageous when applied to refractory, aromatic feedstocks such as slurry decanted oils from catalytic cracking and tars from thermal cracking. In coking, the heavy aromatics in the resid are condensed to form coke, about 15-25 weight percent of the charge being used for coke making. The remaining material is cracked to naphtha and gas oil that can be charged to reforming and catalytic cracking.

Residual petroleum oil fractions, such as those fractions produced by atmospheric and vacuum crude distillation columns, are typically characterized as being undesirable as feedstocks for direct use in most refining processes. This undesirability is due primarily to the high content of contaminants, i.e., metals, sulfur, nitrogen, and Conradson carbon residue, that are present in said fractions.

Principal metal contaminants are nickel and vanadium, with iron and small amounts of copper also being sometimes present. Additionally, trace amounts of zinc and sodium are found in most feedstocks. As the great majority of these metals when present in crude oil are associated with very large hydrocarbon molecules, the heavier fractions produced by crude distillation contain substantially all of the metals present in the crude, such metals being particularly concentrated in the asphaltene residual fraction. The metal contaminants are typically large organo-metallic complexes such as metalloporphyrins and similar tetrapyrrole structures.

The residual fraction of single-stage atmospheric distillation or two-stage atmospheric/vacuum distillation also contains the bulk of the crude components which deposit as carbonaceous or coke-like material on cracking catalysts without substantial conversion. These are frequently referred to as "Conradson carbon" from the analytical technique of determining their concentration in petroleum fractions.

A process that combines hydrothermal treatment with coking is described in U.S. Pat. No. 1,995,005, wherein the residual oil is produced by thermally cracking a topped crude at temperatures of 800°-1600° F. (427°-871° C.) and pressures of atmospheric to 500 psig, removing the vaporous products, and delay coking the residual oil.

Cracking of higher boiling oils without a catalyst is discussed in U.S. Pat. No. 2,007,226. When higher boiling oils are heated to a cracking temperature, the cracked products include hydrocarbons relatively poor in hydrogen which tend to polymerize and form coke or solid or semi-solid pitches. However, the presence of hydrogen in concentrations sufficient to exert more than the characteristic minimum partial pressure tends to inhibit such polymerization and formation of coke and pitches. But, to be effective therefor, the hydrogen must be immediately present, with respect both to time and to place, as the constituent molecules of the higher boiling oil decompose or "crack".

A process for atmospheric distillation followed by vacuum distillation of a petroleum crude is described in U.S. Pat. No. 3,110,663. This process includes visbreaking a mixture of the atmospheric residuum and the vacuum residuum, visbreaking being defined as essentially a single-pass, mild thermal cracking operation in which the heavy oil is passed at rather short residence time through a coil heated to a temperature in the range of about 850°-950° F. (454°-510° C.).

An integrated hydrocarbon conversion process for converting a heavy hydrocarbon feedstock boiling above 650° F. into products including gasoline, jet fuel, and coke is described in U.S. Pat. No. 3,891,538. This process comprises catalytically hydrodesulfurizing the feedstock to produce gasoline, jet fuel, a fraction boiling at 650°-1000° F. (343°-538° C.), and a fraction boiling above 1000° F.; catalytically cracking the hydrodesulfurized material boiling at 650°-1000° F. to produce cracked products and a decant oil; coking the decant oil and the desulfurized product boiling above 1000° F. to produce gasoline, coker gas oil, and the coke; and recycling the catalytic cracker gas cycle oil and coker gas oil to the hydrodesulfurizing operation.

It is pointed out in U.S. Pat. No. 4,005,006 that (1) hydrodesulfurization of catalytic residual oils can reduce their sulfur contents with relatively little hydrocracking if reaction temperatures are kept below about 790° F. (421° C.) and (2) it is advantageous to do so because catalytic hydrocracking reactions generally result in some production of naphtha which is relatively wasteful, for naphtha is easily and economically produced in the absence of added hydrogen by means of fluid catalytic cracking (FCC). Producing naphtha in an FCC process without added hydrogen saves the expense of hydrogen consumption and retains the olefins and aromatics in the naphtha product in an unsaturated state. Because olefins and aromatics are high octane number components, FCC naphtha generally exhibits higher research and motor octane values than does hydrocracked naphtha. This patent accordingly discloses thermal cracking or visbreaking of a residual oil, which may be nonhydrodesulfurized, to convert a portion thereof to middle distillates boiling at 350°-650° F. (177°-343° C.), with relatively small production of 350° F.− −(177° C.−) naphtha and lighter material. Because thermal desulfurization occurs during visbreaking in proportion to the extent of conversion and regardless of whether or not the visbreaker feed oil is hydrodesulfurized, the relatively high conversion provides correspondingly high levels of desulfurization which is aided by, but does not require, the presence of added hydrogen. The visbreaking operation is performed at a preferred temperature of 790°-950° F. (421°-510° C.), a preferred pressure of 100-2500 psig (7-175 kg/cm$^2$), and a preferred hydrogen feed rate of 500-2500 SCF per barrel (8.0-44.5 scm/100L), with a preferred oil residence time in the visbreaker of 0.3-3 hours.

The thermal treatment of residual oils for upgrading them to middle distillates boiling in the furnace oil, diesel fuel, and jet fuel range, in preference to the naphtha range, is described in U.S. Pat. No. 4,062,757.

An improved visbreaking process for residual oils is described in U.S. Pat. No. 4,062,757 in which the residual oil, with or without hydrogen, is passed upwardly through a packed bed of substantially stationary solids to produce improved middle distillate yield. Although it is commonly observed in conventional visbreaking processes that any increase in middle distillate yield is accompanied by disproportionate increase in naphtha yield caused by after cracking, it was found that enhanced production of middle distillates by this upflow process was achieved with both an enhanced yield of middle distillates and an enhanced product ratio of middle distillates to naphtha.

U.S. Pat. No. 4,324,645 describes the upgrading of residua by selectively removing CCR without undue hydrogen consumption by catalytic hydroprocessing to produce a particularly preferable feedstock for coking that gives more liquid yield and less coke make. The catalyst is one whose primary purpose is to limit hydrogen consumption for aromatics saturation and conversion of 1000° F.+ (538° C.+) material, i.e., reactions which selectively contribute to reduction of CCR. The majority of the sulfur is rejected with the coke so that prior sulfur removal during hydroprocessing is unnecessary if the major concern of refining is liquid product from coking rather than the quality of the coke make.

The combination of visbreaking with coking, as has been done in the prior art, tends to produce relatively large amounts of coke without using hydrogen and to be expensive with the use of hydrogen. This cost/benefit consideration is principally a matter of process economics. In terms of technical feasibility, catalytic hydrotreating of metal-containing resids, although expensive, is at least technically practical; however, with high metal-containing resids, the practicality of hyrdrotreating remains doubtful without new advances in technology. Another important consideration is that the addition of hydrogen to the large molecules as they are being thermally cracked during the visbreaking process seems to produce smaller molecules which are susceptible to losing the added hydrogen during subsequent processing. Moreover, the amount of hydrogen that is utilized by a feedstock during thermal treatment depends on the type of feed. If the feedstock is very low in hydrogen, for example, it needs more hydrogen in order to get gasoline plus distillates (G+D) as products in a reasonable amount. An Arab heavy resid is particularly known to be very low in hydrogen content so that unusually large amounts of hydrogen can be absorbed by this oil.

In terms of process economics, there is accordingly a need for a combined thermal treatment and coking process that minimizes costs and maximizes benefits.

SUMMARY OF THE INVENTION

It is therefore an object of this invention to provide a novel combination of processing steps for a heavy hydrocarbon chargestock containing asphaltenes, metals, and other contaminants that will utilize a minimum amount of hydrogen and produce increased amounts of feedstocks for catalytic cracking and a corresponding decrease in coke yield.

It is another object to increase the capability of an oil refinery to process heavy oils without incurring large capital investment.

In accordance with these objectives and the principles of this invention, it has been found that if a resid is thermally treated at a temperature below thermal cracking temperatures and above about 750° F. (399° C.), a space velocity of no more than about 1.5 with or without hydrogen and at a pressure greater than about 400 psig and preferably about 500 psig, the resid is converted to fractions boiling below 1075° F. (579° C.) to a surprising extent. Moreover, the H/C mole ratio for the thermally treated products and the desulfurization that occurs during this thermal treatment are surprisingly large. The amount of hydrogen that is thereby consumed is negligible if hydrogen is used at a pressure of 500 psig, and is merely slight, if hydrogen is used at a pressure that is considerably higher, such as 2000 psig.

It is believed to be pertinent that visbreaking is usually carried out at 6-12 LHSV, with a limiting factor being the coking tendency of the resid.

What has essentially been discovered is that relatively low-temperature thermal treatment, under very uniform conditions that completely avoid "hot spots" and for a length of time that is at least four times and preferably at least six times that of the prior art, produces a uniform and surprisingly extensive breakdown of large molecular weight compounds into smaller compounds that are suitable for catalytic cracking while reducing the fraction boiling at over 1075° F. (579° C.) that is suitable for coking.

The process of the instant invention broadly comprises:

A. thermally treating a heavy hydrocarbon chargestock, containing asphaltenes, metals, and other contaminants, in the absence of an added catalyst and either with or without hydrogen and steam, at a temperature of at least about 750° F. (399° C.) and under a pressure greater than about 400 psig to cause the chargestock to undergo significant chemical transformations in terms of boiling range reduction and hydrogen content and chemical redistribution to produce enrichment of the fractions boiling below 1075° F. (579° C.) without causing a phase separation of the chargestock and consequent formation of sludge or a coke deposit;

B. distilling the product from Step A to recover a distillate fraction and a bottom fraction;

C. coking the bottom fraction to recover gas and liquid products; and

D. combining the distillate fraction from Step B with the liquid products from Step C to form a combined stream and then processing this combined stream in combination with conversion gas oil distillates from a catalytic cracking unit to recover gas, gasoline, and light distillate products.

Laboratory data indicate that preceding the coking and distillation steps with Steps A and B, compared to coking the heavy chargestock directly, produces a surprisingly large increase in feedstocks for catalytic cracking and a corresponding decrease in coke yield. As a result, the capability of a refinery to process heavy oils is greatly increased without requiring a large capital investment.

BRIEF DESCRIPTION OF THE DRAWINGS

FIG. 1 is a schematic flow sheet which illustrates delay coking, fractionation, and catalytic coking of a vacuum resid.

FIG. 2 is a schematic flow sheet for a refinery system embodying thermal treatment, coking, and fluid catalytic cracking operations.

DESCRIPTION OF THE PREFERRED EMBODIMENTS

Figure 3:
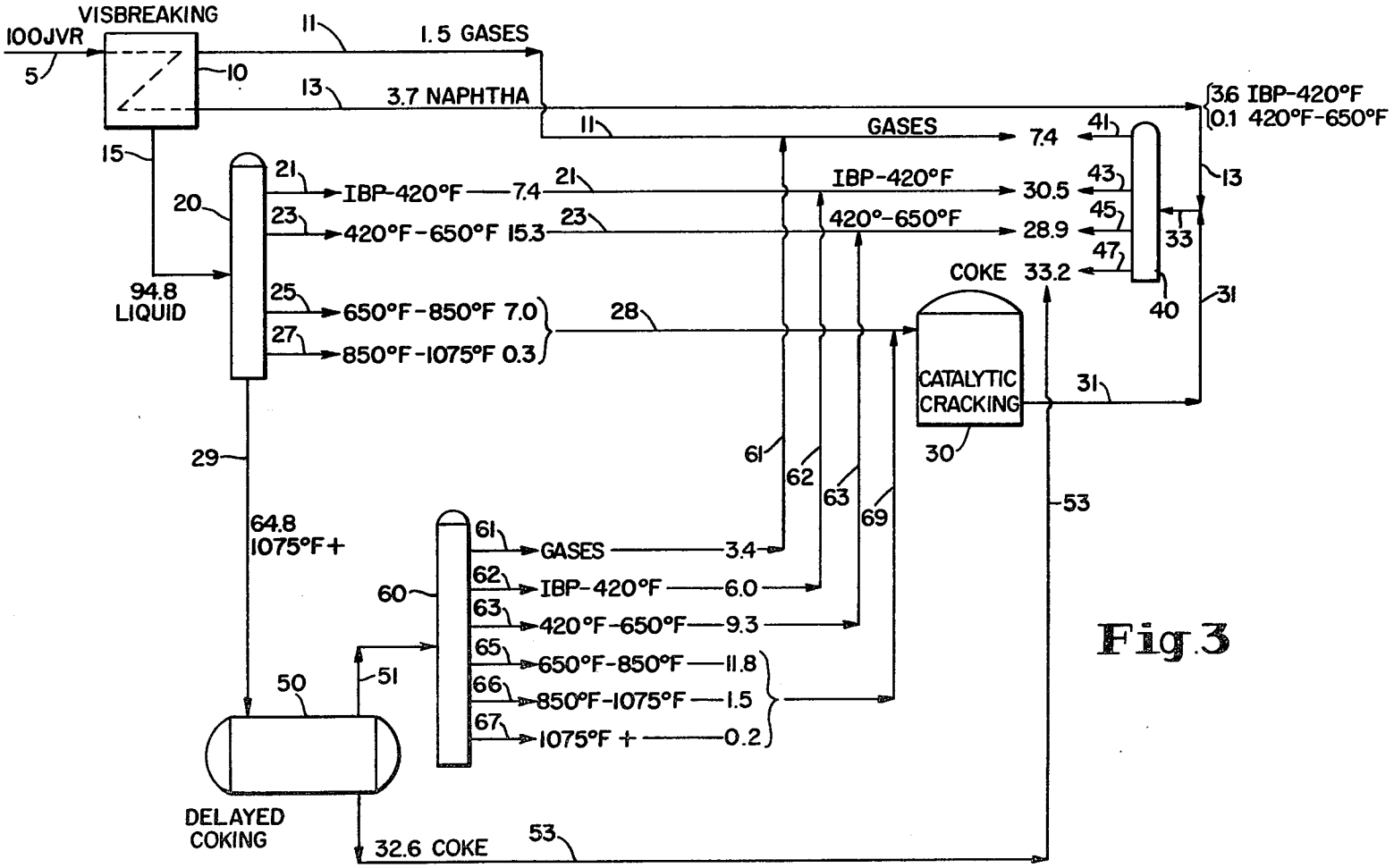
FIG. 3 shows a process which schematically illustrates the material balance of FIG. 2.
Figure 4:
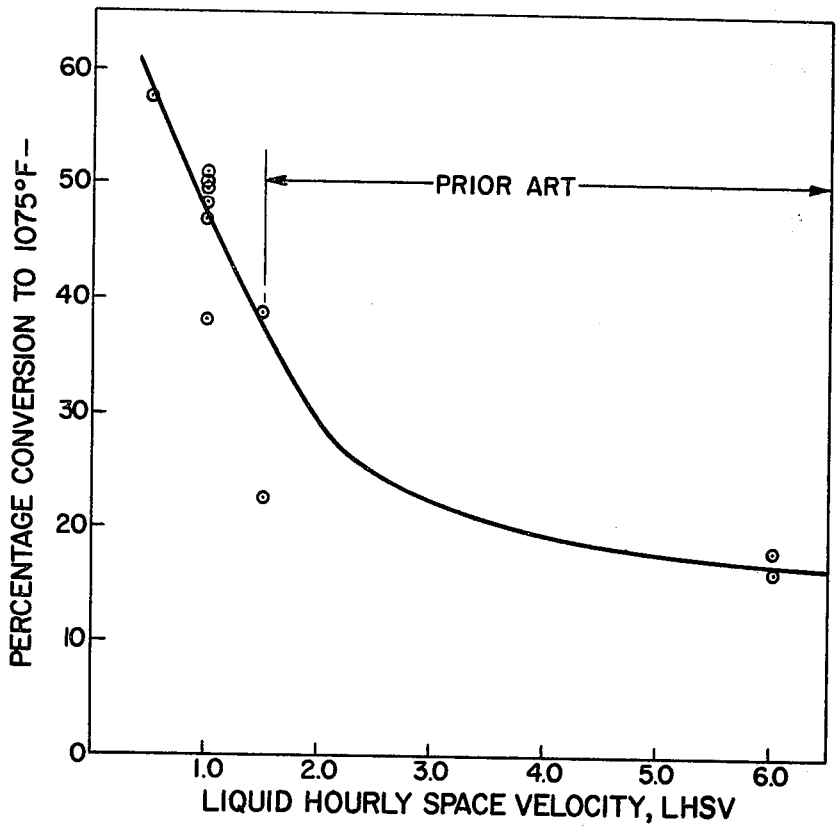

Residual fractions obtained from refineries were analyzed for percentages of carbon, hydrogen, nitrogen, oxygen, and sulfur, and for Conradson carbon residue (CCR), nickel and vanadium content, viscosity, contents of material boiling below 1075° F. (579° C.), and pentane insolubles. In a few cases, the resid was generated in the laboratory by a vacuum distillation of a crude oil.

The equipment used for thermal treatment conprised a one-quarter inch stainless-steel tube which was packed with glass vycor of 12/20 mesh. The tube was heated in an alundum fluidized bath. Thermocouples were located at several places along the tube in order to be sure that heating was occurring evenly. The tube was 8 feet long and contained 40 cc vycor. The typical run was for 5 to 6 hours, and 96 percent recovery was obtained in material balances. Because there was always some slight holdup of coke, each tube was thrown away after use and replaced with a new tube for the next run.

In conducting a thermal treatment run, a gas was admitted to the oil stream, at approximately the inlet to the 8-foot coil, in order to increase the fluidity of the residual oil. Hydrogen was used in all tests except for one test run in which helium was used.

EXAMPLE 1

The analyses for five crude oils, including the two laboratory-generated residuals, are given in Table 1. These include a Melones crude oil that was vacuum distilled in the laboratory to produce two batches having different weight percentages of 1075° F.− materials in them; these batches are designated hereinafter as Melones-A and Melones-B.

TABLE 1

| | Properties of 1075° F.+ Resid Feeds | | | | |
|---|---|---|---|---|---|
| | Arab Heavy 1075° F.+ | Arab Light 1075° F.+ | Melones-A 1075° F.+ | Melones-B 1075° F.+ | Joliet Vacuum 1075° F.+ |
| % C | 85.11 | 85.02 | 84.42 | 84.58 | 85.17 |
| H | 10.16 | 10.35 | 9.63 | 10.10 | 9.97 |
| N | 0.43 | 0.38 | 0.81 | 0.81 | 0.54 |
| O | 0.46 | 0.5 | 0.92 | 0.5 | 0.5 |
| S | 5.24 | 4.17 | 4.44 | 4.54 | 3.96 |
| CCR | 21 | 19.1 | 18.3 | 18.3 | 20.5 |
| ppm Ni | 60 | 24 | 130 | 125 | 51 |
| ppm V | 160 | 89 | 565 | 550 | 240 |
| Viscosity, 210° F. cs | 7000 | 2288 | — | — | 1915 |
| % 1075° F.− | 8.7 | 2.1 | 1.0 | 19.6 | 12.8 |
| Wt. % pentane insolubles | 24.2 | 17.6 | 26.1 | 25.5 | 22.2 |

Thermal treatment occurred at 850° F. (454° C.) and at either 500 psig or 2000 psig and at an LHSV (liquid hourly space velocity) of 0.5 to 6. The LHSV conditions, the pressures, the gas production, the weight percentages for the H/C ratio, the hydrogen content, the sulfur content, and the calculated hydrogen consumption in SCF/bbl are given in Table 2. The boiling range distribution is given in Table 3.

TABLE 2

| LHSV | 1075° F.+ Fraction of Resids Thermally Treated at 850° F. | Gas | Oil Weight % H/C | H | S | H-consumption SCF/bbl |
|---|---|---|---|---|---|---|
| | Arab Hvy | — | 1.42 | 10.2 | 5.24 | — |
| 1 | $H_2$, 500 psig | 1.2 | 1.37 | 9.7 | 5.19 | 0 |
| 1 | $H_2$, 2000 psig | 3.8 | 1.53 | 10.9 | 5.08 | 850 |
| 1 | He, 500 psig | 1.1 | 1.39 | 9.7 | 5.28 | 0 |
| 6 | $H_2$, 500 psig | 0.8 | 1.43 | 10.1 | 5.36 | 0 |
| | Melones Resid-A | — | 1.36 | 9.6 | 4.44 | — |
| 1.5 | $H_2$, 500 psig | 1.6 | 1.36 | 9.6 | 4.21 | 0 |
| | Melones Resid-B | — | 1.42 | 10.1 | 4.54 | 0 |
| 1.0 | $H_2$, 2000 psig | 1.6 | 1.35 | 9.7 | 3.88 | 0 |
| | Joliet | | | | | |

TABLE 3

| LHSV | 850° Thermally Treated Resid | Boiling Range Distribution, °F. Gas | 420 | 420–650 | 650–850 | 850–1075 | 1075+ | Conv.* 1075− |
|---|---|---|---|---|---|---|---|---|
| | Arab Hvy 1075+ Resid | | | | 0.4 | 8.3 | 91.3 | |
| 1 | $H_2$, 500 psig | 1.2 | 11.9 | 15.7 | 15.3 | 7.8 | 48.1 | 47.3* |
| 1 | $H_2$, 2000 psig | 3.8 | 10.8 | 14.7 | 14.6 | 10.8 | 45.4 | 50.3 |
| 1 | He, 500 psig | 1.1 | 9.0 | 16.2 | 15.7 | 11.0 | 46.9 | 48.6 |
| 6 | $H_2$, 500 psig | 0.8 | 3.1 | 6.0 | 7.5 | 7.8 | 74.6 | 18.7* |
| **0.5 | $H_2$, 500 psig | 2.0 | 9.8 | 20.4 | 18.4 | 10.8 | 38.6 | 57.7* |
| | Melones Resid-A | | | | | 1.0 | 99.0 | |
| 1.5 | $H_2$, 500 psig | 1.6 | 6.5 | 9.8 | 11.3 | 10.4 | 60.4 | 39.0 |
| | Melones Resid-B | | 0 | 0 | 1.8 | 17.8 | 80.4 | |
| 1.0 | $H_2$, 2000 psig | 1.6 | 16.4 | 24.7 | 12.2 | 5.3 | 29.8 | 50.9 |
| | Joliet Vac Resid | | 1.9 | 1.8 | 2.7 | 6.9 | 87.2 | |
| 1.0 | $H_2$, 2000 psig | 2.5 | 11.3 | 18.9 | 14.5 | 9.2 | 43.6 | 50.0 |
| ***1.0 | $H_2$, 2000 psig | 1.5 | 11.0 | 15.4 | 7.0 | 0.3 | 64.8 | 38.3 |
| 1.5 | $H_2$, 500 psig | 1.2 | 11.1 | 10.9 | 10.6 | 0.5 | 65.8 | 22.9 |
| | Arab Light 1075+ Resid | | | | | 2.1 | 97.9 | |
| 6.0 | $H_2$, 500 psig | 0.8 | 3.8 | 6.4 | 5.3 | 2.6 | 81.5 | 16.8 |

$$\text{*Conversion to 1075° F.}^- = \left(\frac{\text{1075° F.}^- \text{ liguid and gases} - (\text{\% already 1075° F.}^-)}{\text{\% 1075° F.}^+}\right) \times 100$$

**Not included in Table 2
***See FIG. 2

TABLE 2-continued

| LHSV | 1075° F.+ Fraction of Resids Thermally Treated at 850° F. | Gas | Oil Weight % H/C | H | S | H-consumption SCF/bbl |
|---|---|---|---|---|---|---|
| | Vac. Resid | — | 1.39 | 10.0 | 3.96 | |
| 1.0 | $H_2$, 2000 psig | 2.5 | 1.40 | 10.1 | 3.88 | 330 |
| 1.5 | $H_2$, 500 psig | 1.2 | 1.33 | 9.6 | 2.68 | 0 |
| | Arab Light Resid | — | 1.45 | 10.4 | 4.17 | |
| 6.0 | $H_2$, 500 psig | 0.8 | 1.37 | 9.8 | 4.39 | 0 |

Study of the data in Table 3 clearly shows that conversion generally improved with decrease in LHSV, that increasing the pressure from 500 psig to 2000 psig produced a very slight increase in conversion, and that helium was as effective as hydrogen at 500 psig for Arabian heavy resid. Hydrogenation is consequently a very minor consideration or is entirely inconsequential for this thermal treatment even though chemical bonds were necessarily being broken, as demonstrated by the highly significant conversion to compounds boiling below 1075° F. The Arab heavy resid contained 8.7% by weight boiling below 1075° F. at atmospheric pressure, for example, as seen in Table 1, but after this thermal treatment, its 1075° F.− increased to 51.9%, as seen in Table 3. The hydrogen consumption only became significant at 2000 psig.

It should be noted, however, that the hydrogen consumption was calculated, not measured, from the changes in hydrogen and sulfur contents of the resids. Because the analytical procedures for determining carbon, hydrogen, and sulfur are imprecise, all calculated hydrogen consumption values that were below about 200 SCF/bbl were disregarded as unreliable and written in Table 2 as zero.

It is known that serious coking can occur in visbreaking and similar thermal treating operations. Yet in the thermal treatments of this invention, very little coke was made. As determined by careful weighing of several of the tubes before a run and after washing with toluene and drying, it is believed that only about 0.5% or less of the material was converted to coke.

EXAMPLE 2

A Boscan resid was similarly thermally treated at 850° F. (454° C.), 2000 psig of hydrogen, and LHSV of 1.0. The analyses for carbon, hydrogen, nitrogen, sulfur, nickel, vanadium, and molybdenum, the percent conversion to materials boiling below 1075° F. (579° C.) and the hydrogen consumption are given in Table 4 for this resid.

TABLE 4

| Thermally Treated Boscan Resid 850° F., 2000 psig $H_2$, LHSV = 1.0 | Boscan Resid Feed | Thermally Treated Resid |
|---|---|---|
| C | 82.33 | 84.81 |
| H | 10.05 | 10.12 |
| N | 0.83 | 1.04 |
| S | 6.17 | 4.11(33% deS) |
| ppm Ni | 140 | 198 |
| ppm V | 1490 | 1370 |
| ppm Mo | 5.3 | 2 |
| % Conversion to 1075° F.− | — | 52.3 |
| H-consumption | — | 740 SCF/bbl |

EXAMPLE 3

A Joliet vacuum resid was used as a feedstock for another run in which slightly different analytical and treatment procedures were employed. The percentages of carbon, hydrogen, nitrogen, oxygen, and sulfur, the CCR content, the nickel content, and the vanadium content are given in Table 5 for the feedstock and for both the below 1075° F. fraction and the above 1075° F. fraction.

This resid has properties, as shown in Table 5, which cause it to be difficult to process according to conventional refinery upgrading schemes. If 100 parts of this Joliet vacuum resid are subjected to delayed coking to produce a gas product, a combined liquid product, and a coke product, the liquid product can then be fractionated to produce a fraction boiling between the initial boiling point and 420° F. (216° C.), a fraction boiling between 420° and 650° F. (343° C.), and a fraction boiling above 650° F. The last fraction can next be catalytically cracked and then fractionated to produce gas, two liquid fractions, and coke. The total, as shown in FIG. 1, shows a large amount of coke production of 40.2% by weight.

If the same resid is initially thermally treated and preferably hydrothermally treated at 2000 psig and 1.0 LHSV, if the resulting liquid fraction boiling above 650° F. is then fractionated to produce a fraction boiling above 1075° F. which is delay coked, and if the liquid fractions obtained from delay coking and from the topping operations that boil between 650° and 1075° F. are catalytically cracked, the combined product slate, as shown in FIG. 2, is considerably more favorable with respect to coke production and even lower gas production. Specifically, only 33.2% of coke is made as compared to 40.2%, the gas production is 7.4% as compared to 9.6%, and the naphtha production is 30.5% boiling up to 420° F. and 28.9% boiling at 420°-650° F., as compared to 27.3% and 22.9%, respectively.

These results indicate that the delay coker feed with thermal treatment is less than two-thirds as much as with no thermal treatment, thereby significantly increasing coker capacity.

TABLE 5

| Joliet Vacuum Resid Feed | | |
|---|---|---|
| % C | 85.17 | |
| H | 9.97 | |
| N | 0.54 | |
| 0 | 0.5 | |
| S | 3.96 | |
| CCR | 20.5 | |
| ppm Ni | 51 | |
| V | 240 | |
| Hydrothermally Treated Products (Liquid) | | |
| | 1075° F.+ Portion | 1075° F.− Portion |
| % C | 85.65 | 85.45 |
| H | 5.55 | 12.26 |
| N | 0.62 | 0.08 |
| 0 | 0.77 | .5 |
| S | 4.38 | 2.24 |
| CCR | 29.32 | |
| ppm Ni | 72 | |
| ppm V | 350 | |

FIG. 3 is a flow sheet which schematically illustrates the material balance of FIG. 2. The unit operations of the process shown in FIG. 3 include a visbreaker 10 in which thermal treatment is conducted, a fractionator 20 for most of the thermally treated liquid from visbreaker 10, a catalytic cracker 30 for the liquid boiling above about 650° F. from fractionator 20 and from a delayed coker 50, a fractionator 40 for the naphtha material produced in visbreaker 10 and for the catalytically cracked products of cracker 30, a delayed coker 50, and a fractionator 60 for the liquid products of delayed coker 50.

Specifically, on a weight basis, feedstream 5 delivers 100 parts of Joilet Vacuum Resid to visbreaker 10 wherein relatively low-temperature thermal treatment, under very uniform conditions that completely avoids "hot spots" and at 0.5-6 liquid hourly space velocity, produces 1.5 parts of gases in stream 11, 3.7 parts of naphtha in stream 13, and 94.8 parts of liquid in stream 15. Naphtha stream 13 consists of 3.6 parts boiling between the initial boiling point (IBP) and 420° F. and 0.1 part boiling between 420° F. and 650° F.

Fractionator 20 produces 7.4 parts of IBP-420° F. in stream 21, 15.3 parts of 420°-650° F. in stream 23, 7.0 parts of 650°-850° F. in stream 25, 0.3 parts of 850°-1075° F. in stream 27, and 64.8 parts of 1075°F.+ in stream 29. Stream 29 enters delayed coker 50 which produces 32.2 parts of liquid in stream 51 and 32.6 parts of coke in stream 53. Stream 51 enters fractionator 60 which produces 3.4 parts of gases in stream 61, 6.0 parts of IBP-420° F. in stream 62, 9.3 parts of 420°-650° F. in stream 63, 11.8 parts of 650°-850° F. in stream 65, 1.5 parts of 850°-1075° F. in stream 66, and 0.2 parts of 1075° F.+ in stream 67. Streams 65, 66, and 67 are combined as stream 69 which is combined with stream 28, representing stream 25 and stream 27. Combined streams 28 and 69 are fed to catalytic cracker 30 which produces a catalytically cracked stream 31 which is combined with naphtha stream 13 as stream 33, feeding fractionator 40. The products therefrom are gases in stream 41, IBP-420° F. products in stream 43, 420°-650° F. products in stream 45 and coke in stream 47.

Stream 11 plus stream 41 produce 7.4 parts of gases. Stream 21 plus stream 43 produce 30.5 parts of IBP-420° F. liquids. Stream 23 plus stream 45 produce 28.9 parts of 420° F.-650° F. liquid. Stream 47 plus stream 43 produce 33.2 parts of coke.

What is claimed is:

1. A process for treating a heavy hydrocarbon feedstock, comprising asphaltenes, metals, and sulfur, said process consisting essentially of the following steps A. thermally treating said feedstock in the absence of an added catalyst at a temperature below thermal cracking temperatures and above about 750° F., a space velocity of no more than about 1.5, and at a pressure greater than about 400 psig to produce gas, naphtha, and a liquid without formation of a sludge, a coke, or a coke deposit;

B. fractionating said liquid to produce fractions boiling below about 650° F., between about 650° and about 1075° F., and above about 1075° F.;

C. delay coking said fraction boiling above 1075° F. to produce liquid products and coke;

D. fractionating the liquid products of said coking to produce fractions boiling below about 650° F. and above about 650° F.;

E. combining said fraction boiling between about 650° and about 1075° F. from said fractionating of Step B with said fraction boiling above about 650° F. from said fractionating of Step D and catalytically cracking said combined fractions in a fluid catalytic cracking process to produce gases and a liquid product; and Z F. fractionating said naphtha of Step A and said gases and said liquid product of Step E to produce gases and products boiling between the initial boiling point and about 650° F.

2. The process of claim 1, wherein said hydrogen is added to said feedstock before said thermal treatment to form a mixture having increased fluidity.

3. The process of claim 2, wherein said thermal treatment is at about 500 psig of hydrogen pressure.

4. The process of claim 2, wherein said thermal treatment is conducted at about 2000 psig of hydrogen pressure.

5. The process of claim 2, wherein said fluid mixture is passed through a finely divided inert solid under conditions providing uniform heat transfer.

6. The process of claim 1, wherein a nonreactive gas is added to said feedstock before said thermal treatment to form a mixture having increased fluidity.

7. The process of claim 6, wherein said nonreactive gas is selected from the group consisting of helium, nitrogen, carbon dioxide, argon, methane, and steam.

8. The process of claim 6, wherein said nonreactive gas is at a pressure of about 500 psig.

9. The process of claim 7, wherein said mixture is passed through a finely divided inert solid under conditions providing uniform heat transfer.

10. The process of claim 5, wherein said mixture is subjected to said thermal treatment at a liquid hourly space velocity of 0.5–6.

* * * * *

UNITED STATES PATENT AND TRADEMARK OFFICE

CERTIFICATE OF CORRECTION

PATENT NO. : 4,443,325

DATED : April 17, 1984

INVENTOR(S) : Nai Y. Chen and Lillian A. Rankel

It is certified that error appears in the above-identified patent and that said Letters Patent are hereby corrected as shown below:

Col. 3, line 22, the hyphen (-) between "F.-" and "(177° C.)" should be deleted.

Col. 4, lines 66-67, "charges-tock" is divided incorrectly; it should be --charge-stock--.

Col. 6, line 68 and Col. 7, line 32, Table 2, the subtitle "Joliet Vac. Resid" has been improperly separated. "Joliet" appears in Col. 6, line 68, while "Vac. Resid" appears at Col. 7, line 32.

Col. 7, line 39, the phrase "in Table 3" should be deleted.

Col. 8, Table 3, the asterisk (*) appearing after "47.3" should be deleted.

Col. 8, Table 3, the asterisk (*) appearing after "18.7" should be deleted.

Col. 8, Table 3, the asterisk (*) appearing after "57.7" should be deleted.

UNITED STATES PATENT AND TRADEMARK OFFICE

CERTIFICATE OF CORRECTION

PATENT NO. : 4,443,325

DATED : April 17, 1984

INVENTOR(S) : Nai Y. Chen and Lillian A. Rankel

It is certified that error appears in the above-identified patent and that said Letters Patent are hereby corrected as shown below:

Col. 10, line 30, Claim 1, the colon (:) after "steps" has been omitted.

Col. 10, line 53, Claim 1, "Z" after "and" should be deleted.

Col. 10, line 66, Claim 5, "fluid" should be deleted after "said".

Col. 11, lines 1-9, Claims 6 and 7 should be single spaced.

Signed and Sealed this

*Sixth* Day of *November 1984*

[SEAL]

*Attest:*

GERALD J. MOSSINGHOFF

*Attesting Officer*

*Commissioner of Patents and Trademarks*